US011912523B2

(12) United States Patent
Umeda et al.

(10) Patent No.: US 11,912,523 B2
(45) Date of Patent: Feb. 27, 2024

(54) FEEDING DEVICE

(71) Applicant: SEIKO EPSON CORPORATION, Tokyo (JP)

(72) Inventors: Takanori Umeda, Shiojiri (JP); Hiroaki Takei, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 20 days.

(21) Appl. No.: 17/209,379

(22) Filed: Mar. 23, 2021

(65) Prior Publication Data

US 2021/0300697 A1 Sep. 30, 2021

(30) Foreign Application Priority Data

Mar. 25, 2020 (JP) ..... 2020-053835

(51) Int. Cl.
*B65H 3/06* (2006.01)
*B65H 5/06* (2006.01)

(52) U.S. Cl.
CPC ..... *B65H 3/0669* (2013.01); *B65H 5/06* (2013.01); *B65H 2403/72* (2013.01); *B65H 2801/06* (2013.01)

(58) Field of Classification Search
CPC .... B65H 3/0669; B65H 5/06; B65H 2403/72; B65H 2601/324
See application file for complete search history.

(56) References Cited

U.S. PATENT DOCUMENTS

2009/0267293 A1* 10/2009 Watanabe ..... B65H 3/0638 271/264
2018/0120726 A1* 5/2018 Aono ..... B65H 27/00
2018/0127223 A1* 5/2018 Horita ..... B65H 3/68
2019/0094783 A1* 3/2019 Koga ..... B65H 3/0684

FOREIGN PATENT DOCUMENTS

JP 2014-214013 11/2014
JP 2017-121990 A 7/2017

* cited by examiner

*Primary Examiner* — Howard J Sanders
(74) *Attorney, Agent, or Firm* — WORKMAN NYDEGGER

(57) ABSTRACT

A feeding device includes a loading unit at which a printing medium is loaded, a roller that transports the printing medium, a transport path member at which the roller is disposed, the transport path member constituting a transport path on which the printing medium is transported, a drive source that generates a drive force that rotates the roller, a clutch that is movable between a coupling position at which the drive force is transmitted to the roller, and a release position at which the drive force is not transmitted to the roller, and an operation unit for operating the clutch, in which the operation unit is provided at a position, on the transport path member, facing the printing medium being transported by the roller, and the roller is removable from the transport path member when the clutch is located at the release position.

5 Claims, 12 Drawing Sheets

FEEDING DEVICE

The present application is based on, and claims priority from JP Application Serial Number 2020-053835, filed Mar. 25, 2020, the disclosure of which is hereby incorporated by reference herein in its entirety.

BACKGROUND

1. Technical Field

The present disclosure relates to a feeding device.

2. Related Art

In the related art, there is known a feeding device that transports loaded media one by one. For example, JP 2014-214013 A discloses a configuration including a pickup roller that feeds out a medium, a feed roller that transports the medium, and a retard roller that presses against the feed roller.

The feeding device extends its life duration by replacing the pickup roller. Unfortunately, in the feeding device described in JP 2014-214013 A, the pickup roller is coupled to a drive source that rotatably drives the pickup roller, which makes it difficult to easily replace the pickup roller.

SUMMARY

A feeding device includes a loading unit at which a printing medium is loaded, a first roller that transports the printing medium, a transport path member at which the first roller is disposed, the transport path member constituting a transport path on which the printing medium is transported, a drive source that generates a drive force that rotates the first roller, a clutch that is movable between a coupling position at which the drive force of the drive source is transmitted to the first roller, and a release position at which the drive force of the drive source is not transmitted to the first roller, and an operation unit for operating a movement of the clutch, in which the operation unit is provided at a position, on the transport path member, facing the printing medium being transported by the first roller, and the first roller is removable from the transport path member when the clutch is located at the release position.

DESCRIPTION OF EXEMPLARY EMBODIMENTS

1. Embodiment

Figure 1:
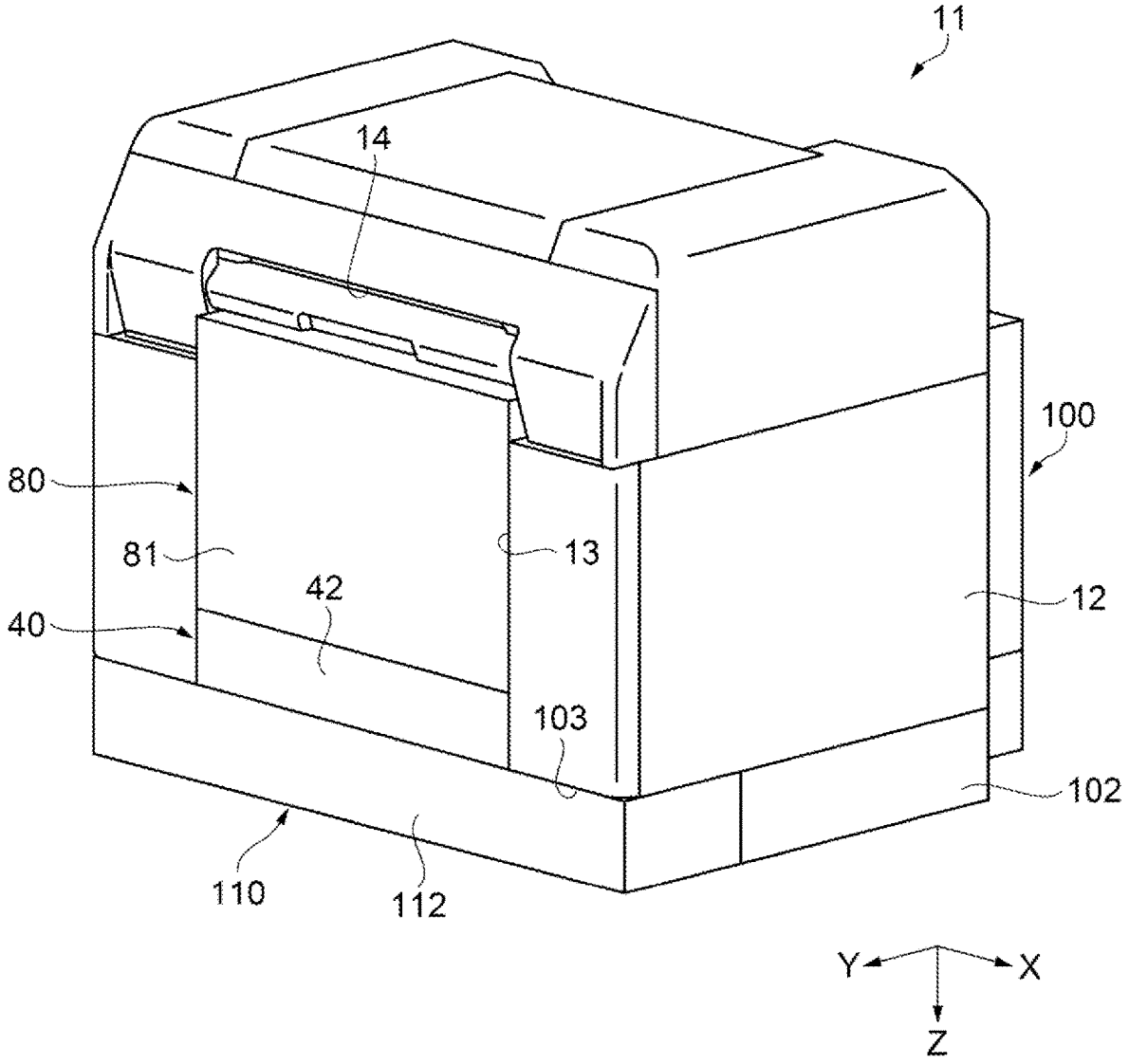
FIG. 1 is a perspective view illustrating an external appearance of a printing apparatus including a feeding device according to an embodiment.

Schematic configurations of a feeding device 100 and a printing apparatus 11 including the feeding device 100 according to the embodiment will be described. The printing apparatus 11 is an inkjet type printer configured to discharge ink to perform printing on a printing medium, for example. In the coordinates appended in the drawings, three virtual axes orthogonal to one another are designated as X, Y, and Z axes on the supposition that the printing apparatus 11 is placed on a horizontal face. The Y axis is an axis that is parallel to a front-back direction of the printing apparatus 11, and a leading end side of an arrow indicating the Y axis is designated as "front". The X axis is an axis that is parallel to a left-right direction of the printing apparatus 11, and a tip end side of an arrow indicating the X axis is designated as "right". The Z axis is a virtual axis that is parallel to a vertical direction, and a tip end side of an arrow indicating the Z axis is designated as "lower".

Figure 2:
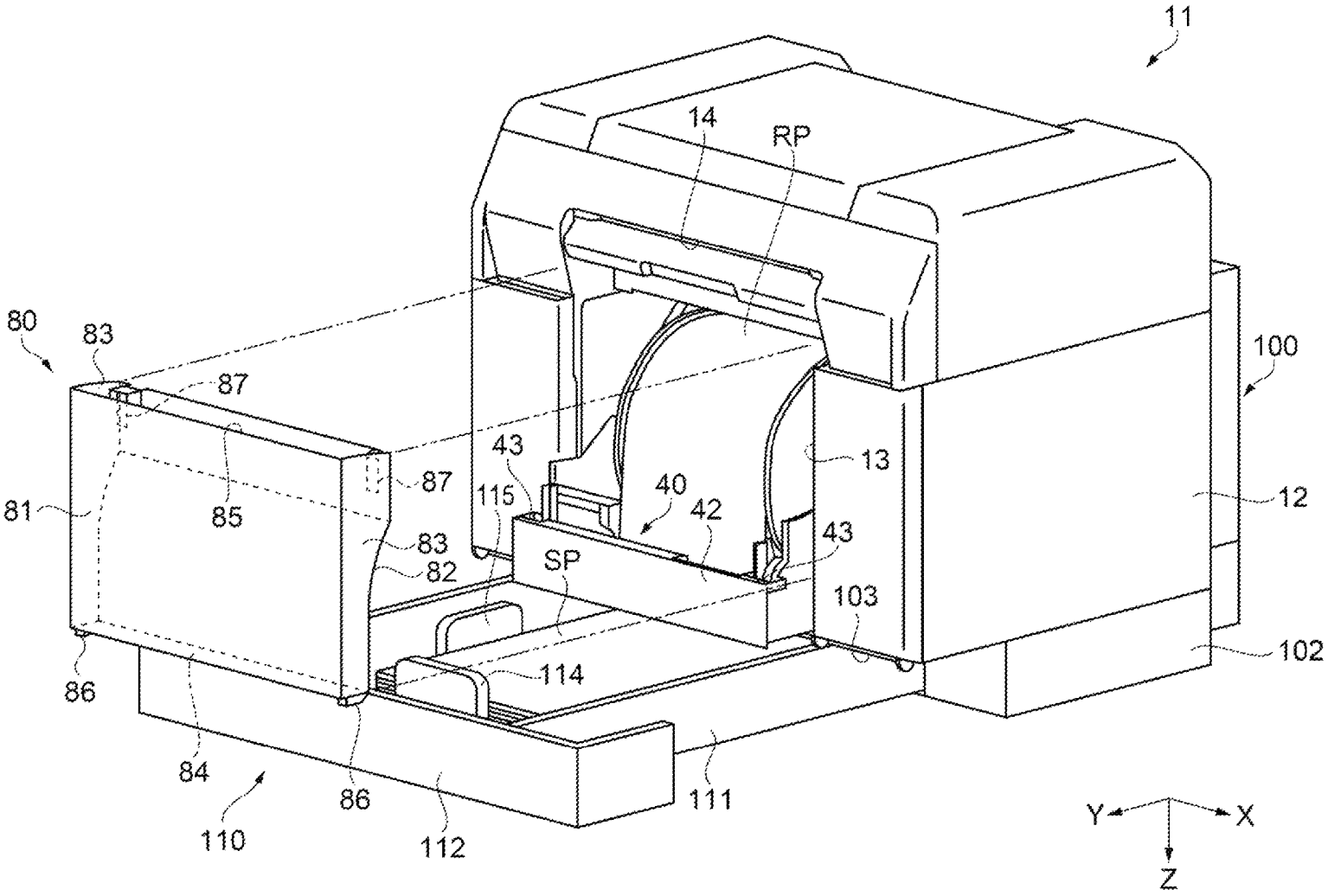
FIG. 2 is a perspective view illustrating a state where a roll paper accommodating unit and a cut paper accommodating unit are moved forward.
Figure 3:
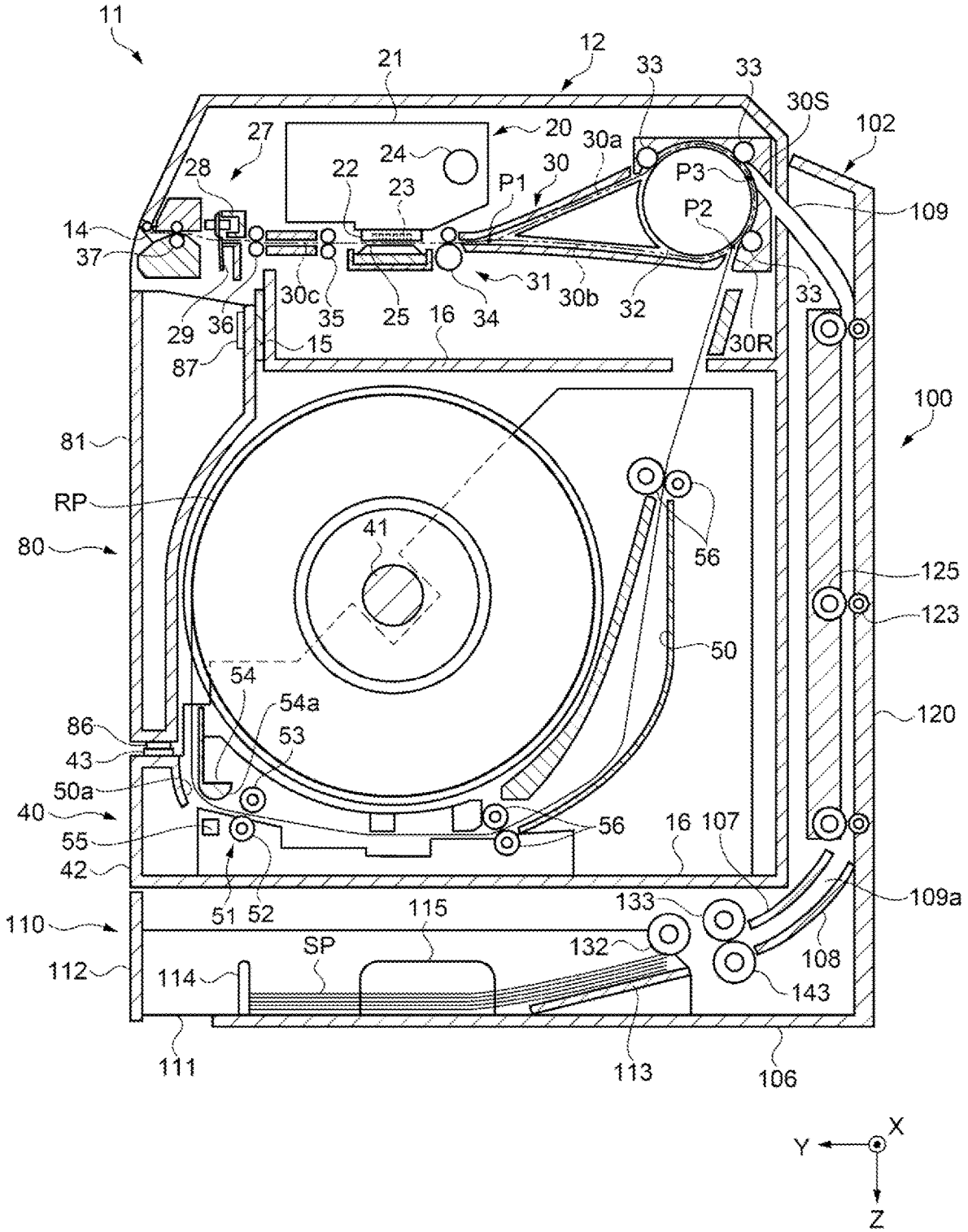
FIG. 3 is a cross-sectional view schematically illustrating internal configurations of a feeding device and a printing apparatus.

As illustrated in FIGS. 1 to 3, the printing apparatus 11 includes a roll paper accommodating unit 40 configured to accommodate roll paper RP that is the printing medium, and a printing unit 20 configured to perform printing on the printing medium. The feeding device 100 includes a cut paper accommodating unit 110 as a loading unit at which cut paper SP that is the printing medium is loaded, the cut paper accommodating unit 110 being configured to feed the cut paper SP to the printing unit 20 of the printing apparatus 11. The feeding device 100 has an L-shape when viewed from a side face in an X direction, and is located downward and backward of the printing apparatus 11.

1-1. Printing Apparatus

The printing apparatus 11 includes a housing 12 of a rectangular parallelepiped shape, and a main body frame 16 that supports portions of the printing apparatus 11. The housing 12 is provided, inside the housing 12, with the roll paper accommodating unit 40 configured to accommodate the roll paper RP, and the printing unit 20 configured to perform printing on the roll paper RP supplied from the roll paper accommodating unit 40 and configured to perform printing on the cut paper SP fed by the feeding device 100. The roll paper accommodating unit 40 is located downward of the printing unit 20 in the vertical direction.

The printing unit 20 includes a head 22 including a nozzle 23 configured to discharge ink toward the printing medium, a carriage 21 on which the head 22 is mounted, and a guide rail 24 disposed along the X axis. The printing unit 20 also includes a movement mechanism that reciprocally moves the carriage 21 along the guide rail 24. A support unit 25 that supports the printing medium is provided at a position facing the head 22. The head 22 discharges ink while reciprocally moves in a paper width direction of the printing medium together with the carriage 21, to perform printing on the printing medium supported by the support unit 25. Note that, in the embodiment, a serial head type in which the head 22 reciprocally moves in the paper width direction is exemplified as the printing unit 20, and a printing unit may be a line head type in which heads extend in the paper width direction and are fixedly aligned.

At an upper portion of the housing 12, there are provided a medium transport path 30 on which the printing medium is transported, and a cutting unit 27 configured to cut the printing medium on which printing has been performed at the printing unit 20. The medium transport path 30 includes a supply path 30*a* and a reverse path 30*b* that are provided upstream of the support unit 25, and an ejection path 30*c* provided downstream of the support unit 25. Moreover, the supply path 30*a* includes a roll paper supply path 30R on which the roll paper RP is supplied, and a cut paper supply path 30S on which the cut paper SP is supplied.

The supply path 30*a* is a path that connects from the roll paper supply path 30R to the support unit 25. A roll paper joining point P2 that joins up with the roll paper supply path 30R is provided upstream of the supply path 30*a*. A branch point P1 that branches from the supply path 30*a* when the printing medium is transported downstream to upstream is provided downstream of the supply path 30*a*. The reverse path 30*b* is a path that connects from the branch point P1 to the roll paper joining point P2. A cut paper joining point P3 that joins up with the cut paper supply path 30S is provided, on the supply path 30*a*, between the roll paper joining point P2 and the branch point P1.

An ejection port 14 through which the printing medium on which printing has been performed is ejected is provided at a front face of the housing 12. Note that, in the embodiment, the front face of the housing 12 is a face that faces frontward of the housing 12. The ejection path 30*c* is a path that connects from the support unit 25 to the ejection port 14. The cutting unit 27 configured to cut the printing medium on which printing has been performed at the printing unit 20 is provided midway on the ejection path 30*c*. The cutting unit 27 includes a movable blade 28 configured to reciprocally move along the X axis that is the paper width direction of the printing medium, and a fixed blade 29 that extends in the paper width direction and is fixed. The movable blade 28 is provided upward of the ejection path 30*c*, and the fixed blade 29 is provided downward of the ejection path 30*c*. When the movable blade 28 moves in the paper width direction while abutting against the fixed blade 29, the roll paper RP, a blank space portion, and the like that are unwound from a rolled state are cut, for example. A cutting waste accommodating unit 80 configured to accommodate the cutting waste generated by the cutting by the cutting unit 27 is provided downward of the cutting unit 27.

The medium transport path 30 is provided with a transport unit 31 that transports the printing medium that is supplied onto the medium transport path 30. The transport unit 31 includes, on the supply path 30*a*, an intermediate roller 32, a plurality of driven rollers 33 provided at an outer circumference of the intermediate roller 32, and an upstream transport roller pair 34 in the order from the upstream. The driven roller 33 is rotatably provided, and driven rotates pinching the printing medium between the driven roller 33 and the intermediate roller 32. The transport unit 31 includes, on the ejection path 30*c*, a downstream transport roller pair 35, a first roller pair 36, and a second roller pair 37 in the order from the upstream. The first roller pair 36 is located upstream of the cutting unit 27 and the second roller pair 37 is located downstream of the cutting unit 27.

The intermediate roller 32, the driven roller 33, the upstream transport roller pair 34, the downstream transport roller pair 35, the first roller pair 36, and the second roller pair 37 rotate in a state of pinching the printing medium therebetween to transport the printing medium. The transport unit 31, by being forward driven, transports the printing medium to a positive side of the Y axis, that is, from the upstream to the downstream. The transport unit 31, by being reverse driven, transports the printing medium to a negative side of the Y axis, that is, from the downstream to the upstream.

The printing apparatus 11 causes the printing unit 20 to discharge ink onto the printing medium located at the support unit 25 while forward driving the transport unit 31 to transport the printing medium from the upstream to the downstream, to perform printing on a first face of the printing medium. The printing apparatus 11 is configured to perform printing on a second face that is a back face of the first face of the printing medium. The printing apparatus 11 reverse drives the transport unit 31 to transport the printing medium having the first face on which printing has been performed from the downstream to the upstream. The printing medium reaches the upstream of the supply path 30*a* from the branch point P1 through the reverse path 30*b*. The printing apparatus 11 forward drives the transport unit 31 again and the printing medium rotates once around the outer circumference of the intermediate roller 32, whereby the front and back side of the printing medium are reversed. The printing apparatus 11 causes the printing unit 20 to discharge ink onto the printing medium located at the support unit 25 while transporting the printing medium from the upstream to the downstream, to perform printing on the second face of the printing medium. This allows printing to be performed on both faces of the printing medium. Note that in case where the printing medium is the roll paper RP unwound from a rolled state, printing is performed on the back face of the printing medium cut into cut paper by the cutting unit 27 after printing on the front face.

As illustrated in FIG. 3, the roll paper accommodating unit 40 is provided, inside the housing 12, downward of the printing unit 20 in the vertical direction. The roll paper accommodating unit 40 includes a front plate portion 42 that forms a part of the housing 12 at a lower portion of the front face. In the roll paper accommodating unit 40, the roll paper RP is rotatably supported via a support shaft 41 extending in the X direction of the housing 12. That is, the roll paper RP is supported by the roll paper accommodating unit 40 so as to be rotatable about the support shaft 41 together with the support shaft 41.

The support shaft 41 is configured to be rotatably driven in both the forward and reverse directions. The roll paper RP is rotatably driven via the support shaft 41 in both the forward and reverse directions. In addition, the roll paper accommodating unit 40 is provided with a roll paper transport path 50 for transporting the roll paper RP being unwound from a rolled state toward the roll paper supply path 30R.

The roll paper transport path 50 extends downward from a front side of the roll paper RP supported via the support shaft 41, and then bends backward to turn around a lower side and a back side of the roll paper RP, to extend upward up to a position higher than the roll paper RP as far as the roll paper supply path 30R.

The roll paper transport path 50 includes a bent portion 50*a* bending substantially at a right angle at an upstream end portion of the roll paper transport path 50, that is, at a position diagonally downward of the front of the roll paper RP on the roll paper transport path 50. Further, a decal mechanism 51 for performing a decal correcting a curling habit of the roll paper RP is provided immediately downstream of the bent portion 50*a* on the roll paper transport path 50.

The decal mechanism 51 includes a first decal roller 52, a second decal roller 53, a fixed curved face portion 54 including a curved face 54*a* forming a part of the bent portion 50*a*, and a movement device 55 for moving the first decal roller 52. The first decal roller 52 is disposed, in a state of being vertically movable, downward of the second decal roller 53 and the fixed curved face portion 54. The second decal roller 53 and the fixed curved face portion 54 are arranged, in a state where their respective positions are fixed, with a predetermined interval therebetween so as to be mutually aligned in the front-back direction along the Y axis. The roll paper RP is then transported downstream passing between the first decal roller 52 and the fixed curved face portion 54 and between the first decal roller 52 and the second decal roller 53.

The first decal roller 52 is also moved by drive of the movement device 55 between a release position at which the first decal roller 52 does not press against the roll paper RP illustrated in FIG. 3, and a nip position at which the first decal roller 52 presses against the roll paper RP to pinch the roll paper RP between the first decal roller 52 and the second decal roller 53. Then, when the first decal roller 52 is at the nip position, the roll paper RP having the curling habit is curled and decaled in a direction in which the curling habit is corrected while being guided by the fixed curved face portion 54.

At this time, the first decal roller 52 is located between the second decal roller 53 and the fixed curved face portion 54 in the front-back direction, and the roll paper RP is located between the first decal roller 52 and the fixed curved face portion 54 in the front-back direction. In the embodiment, the second decal roller 53 is configured by a drive roller driven by a motor disposed inside the housing 12, and the first decal roller 52 is configured, when located at the nip position, by a driven roller driven rotated by a rotational drive force, transmitted via the roll paper RP, of the second decal roller 53.

Roll paper transport roller pairs 56 that impart a transport force on the roll paper RP are provided, at an appropriate interval, downstream of the decal mechanism 51 on the roll paper transport path 50. The roll paper transport roller pair 56 is rotatably driven to transport the roll paper RP on the roll paper supply path 30R. The roll paper accommodating unit 40 is supported by the main body frame 16. The roll paper accommodating unit 40, when accommodating the roll paper RP, is exposed frontward of the printing apparatus 11 through an opening portion 13 formed at a center portion of the front face of the housing 12. The roll paper accommodating unit 40 is configured to be movable in a pull-out manner frontward of the printing apparatus 11 with respect to the main body frame 16. That is, the roll paper accommodating unit 40 is configured to be movable to a side to which the printing medium is ejected through the ejection port 14 with respect to the printing apparatus 11.

The cutting waste accommodating unit 80 is located frontward of the roll paper accommodating unit 40 and is removably provided at the main body frame 16. The front plate portion 42, of a pull-out type, of the roll paper accommodating unit 40 is exposed at a lower side of the cutting waste accommodating unit 80.

The cutting waste accommodating unit 80 includes an outer wall 81 that covers the opening portion 13 when the cutting waste accommodating unit 80 is attached to the housing 12, an inner wall 82 that faces the outer wall 81, and side walls 83 that are joined to the outer wall 81 and the inner wall 82 at both ends in the X direction. A bottom wall 84 is provided at a lower end portion of the cutting waste accommodating unit 80, and a receiving port 85 that receives a cutting waste cut by the cutting unit 27 is provided at an upper end portion of the cutting waste accommodating unit 80. The inner wall 82 is curved in conformance with the outer circumference of the roll paper RP in a rolled state.

The cutting waste accommodating unit 80 includes a pair of engagement protrusions 86 protruding downward on both end sides in the X direction of the bottom wall 84. On the other hand, the front plate portion 42 of the roll paper accommodating unit 40 includes a pair of support recesses 43 that open upward at positions on both end sides in the X direction. The cutting waste accommodating unit 80, when attached to the housing 12, is supported by the front plate portion 42 in a state where the engagement protrusion 86 engages with the support recess 43.

The cutting waste accommodating unit 80 includes a pair of metal pieces 87 attached to both end sides in the X direction of an upper end portion of the inner wall 82. In addition, a pair of magnets 15 are attached to the main body frame 16 at positions facing the metal pieces 87 in a state where the cutting waste accommodating unit 80 is supported by the front plate portion 42.

When attaching the cutting waste accommodating unit 80 to the main body frame 16, the engagement protrusion 86 formed on a lower end side is engaged with the support recess 43 of the front plate portion 42, and then an upper end side of the cutting waste accommodating unit 80 is obliquely moved toward a side of the main body frame 16 with the engagement protrusion 86 serving as a supporting point. The cutting waste accommodating unit 80 is then supported by the front plate portion 42 via the engagement protrusion 86, and concurrently therewith, the metal piece 87 is attracted to the magnet 15, to thus maintain a self-supported state where the receiving port 85 faces upward.

As illustrated in FIG. 1, when attaching the cutting waste accommodating unit 80, the opening portion 13 is covered by the outer wall 81 and the front plate portion 42. At this time, an outer face of the outer wall 81 becomes flush with an outer face of the front plate portion 42. That is, the outer wall 81 of the cutting waste accommodating unit 80 and the front plate portion 42 of the roll paper accommodating unit 40 function as parts of the housing 12 of the printing apparatus 11. Also, as illustrated in FIG. 2, in a state where the roll paper accommodating unit 40 is exposed frontward, the cutting waste accommodating unit 80 is removed from the main body frame 16.

1-2. Feeding Device

As illustrated in FIGS. 2 and 3, the feeding device 100 includes a housing 102 of an L-shape when viewed along the X axis from a side face, and a feeding frame 106 that supports portions of the feeding device 100. There are provided, inside the housing 102, the cut paper accommodating unit 110 and a transport path 109 on which the cut paper SP loaded at the cut paper accommodating unit 110 is transported toward the cut paper supply path 30S. The cut paper accommodating unit 110 is located downward of the roll paper accommodating unit 40 in the vertical direction, and the transport path 109 is located backward of the roll paper accommodating unit 40 in the front-back direction.

The cut paper accommodating unit 110 includes, at the front face, a front plate portion 112 that forms a part of the housing 102. The cut paper accommodating unit 110 includes a tray 111 of a box shape that accommodates the cut paper SP. The tray 111 includes a pair of edge guides 115 that are operated when positioning the cut paper SP in the width direction, a stopper 114 that is operated when positioning the cut paper SP in the front-back direction, and a hopper 113 that biases an end portion downstream of the cut paper SP accommodated in the tray 111 to a pickup roller 132.

The cut paper accommodating unit 110 is supported by the feeding frame 106. The cut paper accommodating unit 110, when accommodating the cut paper SP, is exposed frontward of the printing apparatus 11 through an opening portion 103 formed at the housing 102. The cut paper accommodating unit 110 is configured to be movable in a pull-out manner frontward of the printing apparatus 11 with respect to the feeding frame 106.

The feeding device 100 includes the pickup roller 132 as a first roller, a retard roller 143 as a second roller, a separate roller 133 as a third roller, and the like that transport the cut paper SP.

The pickup roller 132 is located upward of an downstream end portion of the cut paper SP accommodated in the cut paper accommodating unit 110. The pickup roller 132 rotates in a state of being in contact with an upper face of the cut paper SP to cause the cut paper SP to be picked up. The retard roller 143 and the separate roller 133 are provided downstream of the pickup roller 132 facing each other in an up-down direction. The retard roller 143 and the separate roller 133 rotate in a state of pinching the cut paper SP being picked up by the pickup roller 132 from the cut paper accommodating unit 110, to feed out the cut paper SP toward the transport path 109.

The separate roller 133 is a roller that is in contact with an upper face that is the same as a face where the pickup roller 132 is in contact with the cut paper SP, and the retard roller 143 is a roller that is in contact with a lower face on an opposite side of the upper face. That is, the retard roller 143 is located downward of the separate roller 133. The retard roller 143 is a roller that is pressed against the separate roller 133 and driven rotates in conjunction with the rotation of the separate roller 133. The retard roller 143 is configured such that a friction coefficient with respect to the cut paper SP is greater than that of the separate roller 133. The separate roller 133 and the retard roller 143 then separate one by one and transport the cut paper SP by the difference in the friction coefficient.

The transport path 109 includes a bent transport path 109*a* that makes the cut paper SP being fed backward from the cut paper accommodating unit 110 bent upward. The bent transport path 109*a* is provided between a second transport path member 108 as a transport path member that supports the lower face of the cut paper SP, and a first transport path member 107 as a transport path member disposed facing the second transport path member 108.

Figure 4:
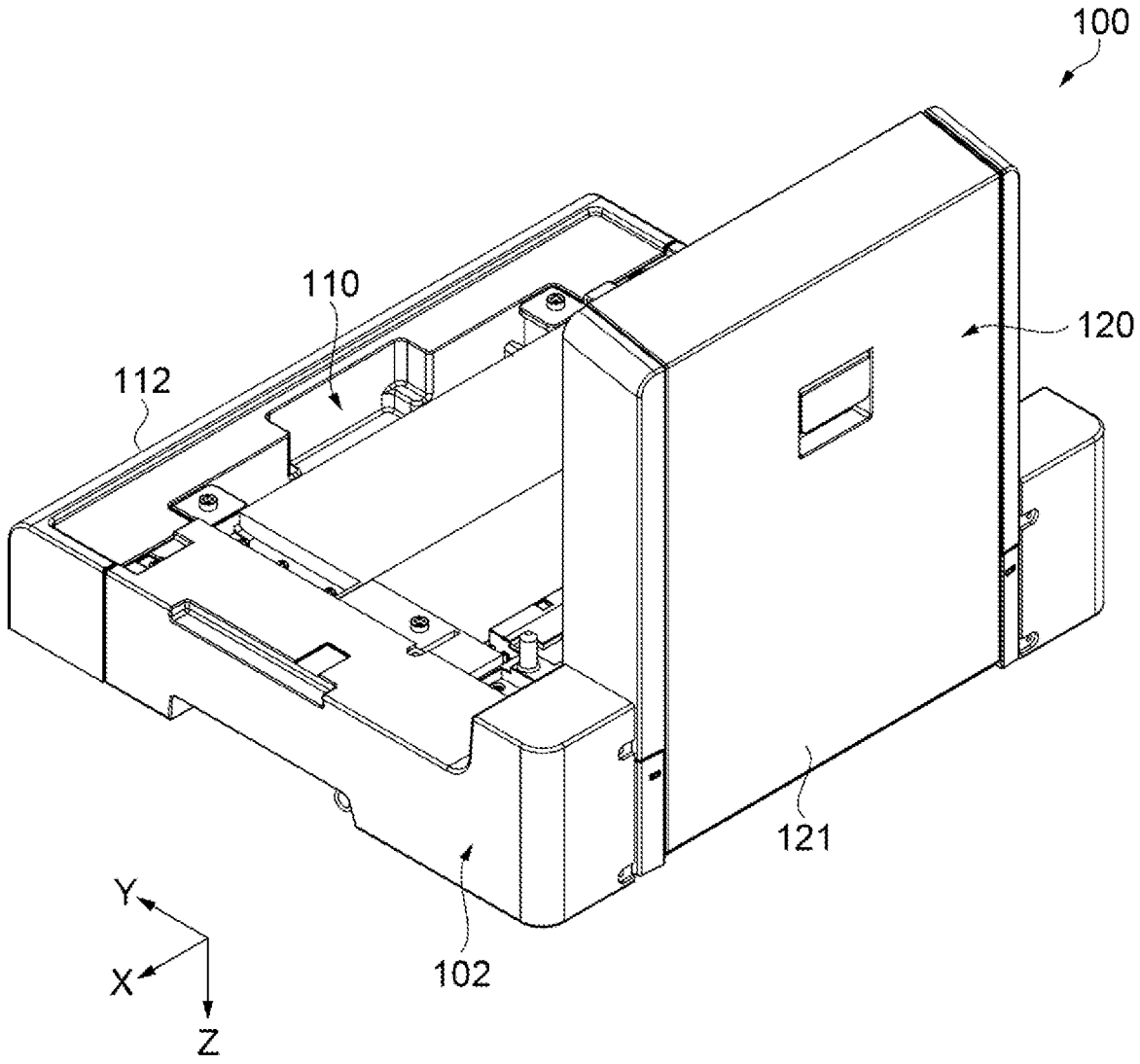
FIG. 4 is a perspective view illustrating an external appearance of a feeding device.
Figure 5:
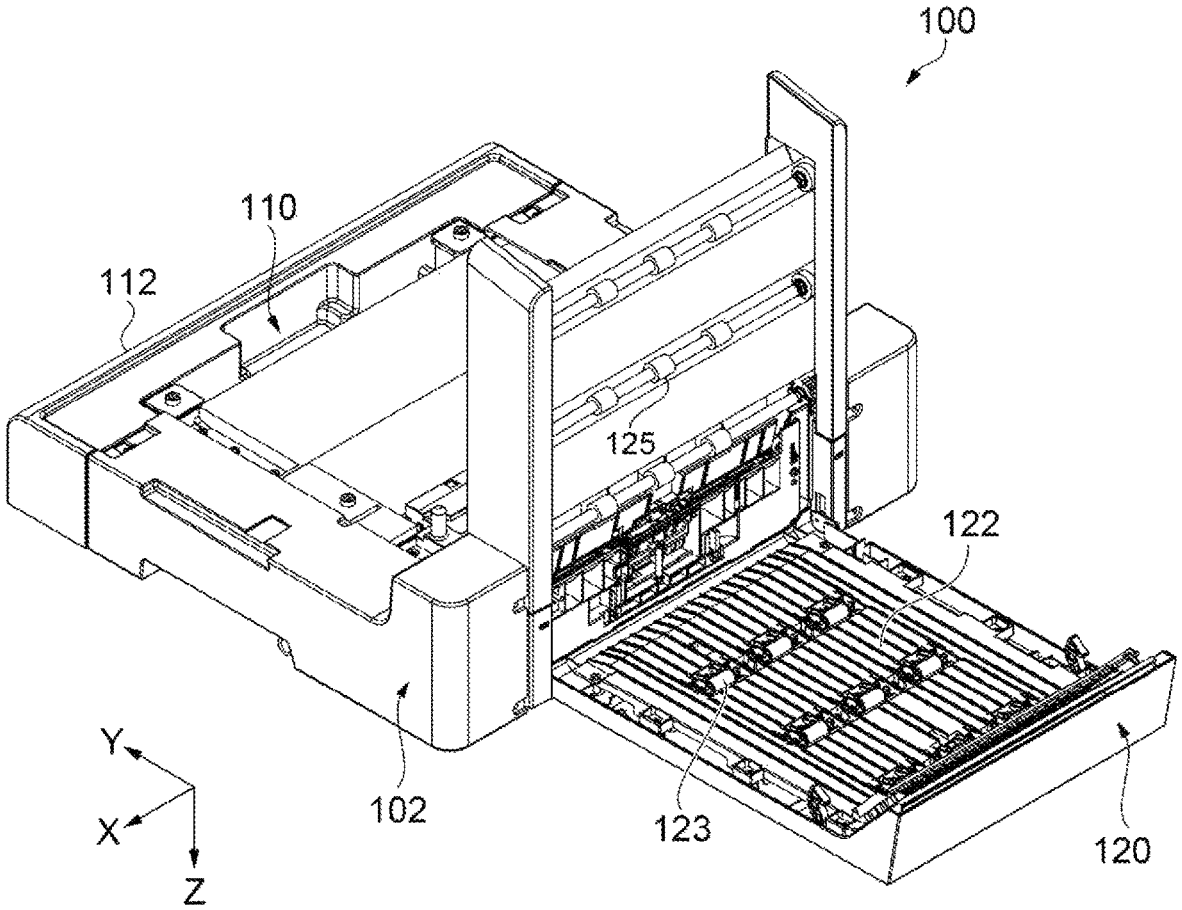
FIG. 5 is a perspective view illustrating a state where a second cover is opened.

As illustrated in FIGS. 4 and 5, the feeding device 100 includes a second cover 120 that covers a back face of the housing 102. The second cover 120 includes a rotation shaft along the X axis at a lower end of the second cover 120, and is pivotally coupled, by the rotation shaft, to a lower portion of the housing 102. In a state where the second cover 120 is closed, an outer wall 121 of the second cover 120 forms a part of the housing 102 and the transport path 109 illustrated in FIG. 3 is configured along an inner wall 122 of the second cover 120. In a state where the second cover 120 is opened, the transport path 109 is exposed. The transport path 109 along the inner wall 122 is provided with cut paper drive rollers 125 that impart a transport forth on the cut paper SP and cut paper driven rollers 123 that are driven rotated via the cut paper SP with the cut paper drive roller, at an appropriate interval. The cut paper drive rollers 125 are rotatably driven to transport the cut paper SP upward from downward.

Figure 6:
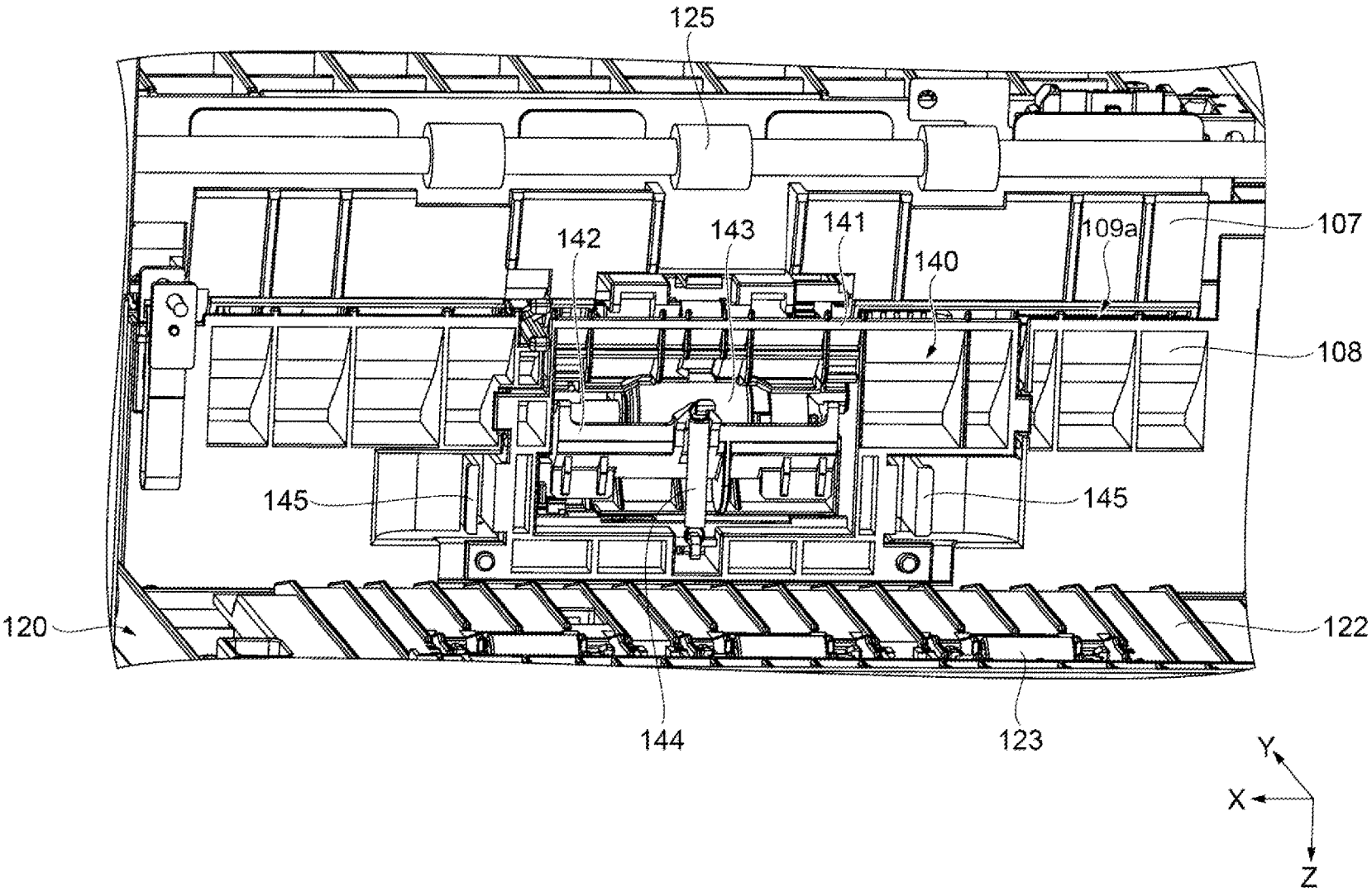
FIG. 6 is an enlarged view illustrating a state where a second cover is opened.
Figure 7:
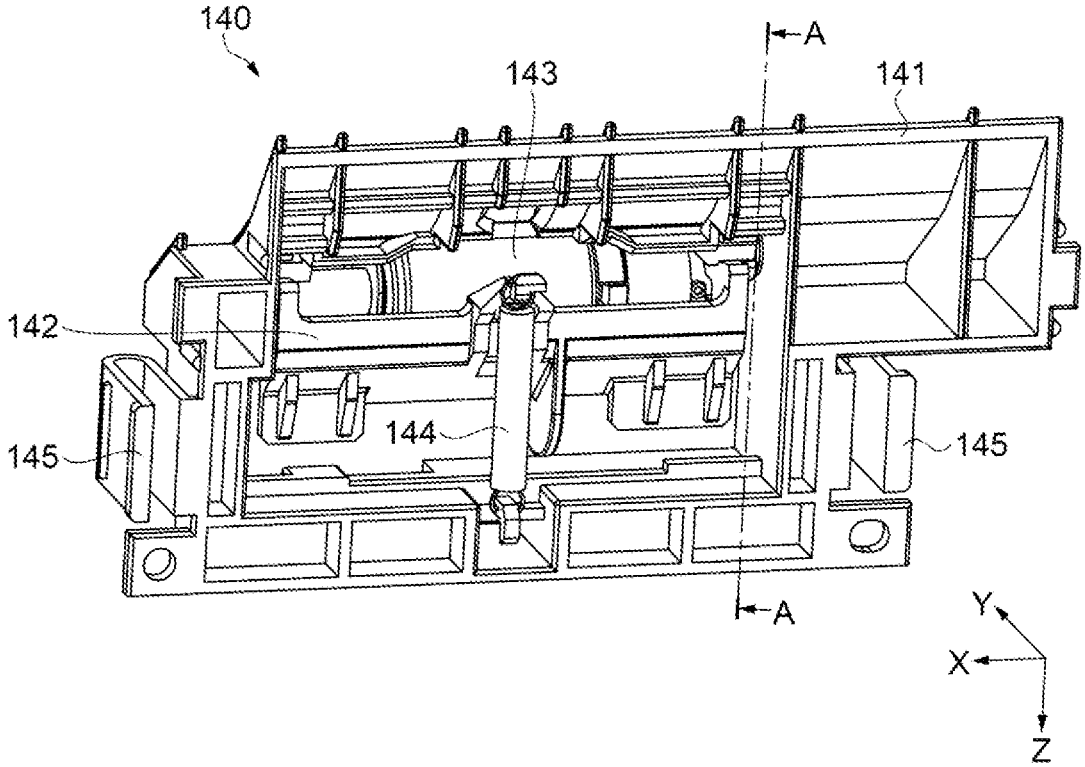
FIG. 7 is a perspective view illustrating a configuration of a second roller unit.
Figure 8:
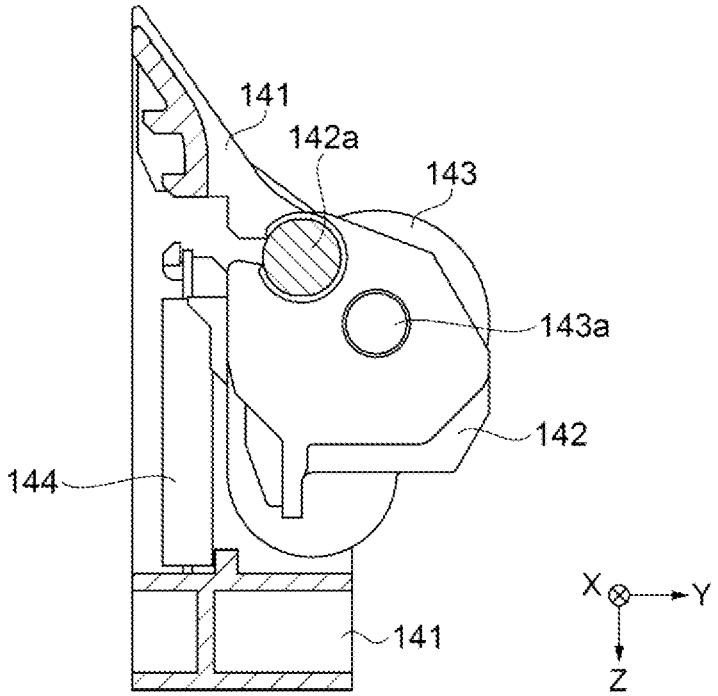
FIG. 8 is a cross-sectional view taken along a line A-A in FIG. 7.

As illustrated in FIGS. 6 to 8, a second roller unit 140 is removably attached to the second transport path member 108. The second roller unit 140 includes the retard roller 143 and a first cover 141 as a second holding unit that holds the retard roller 143. The first cover 141 includes a frame portion 142 that supports the retard roller 143.

The first cover 141 is covered by the second cover 120, and is exposed backward of the housing 102 in a state where the second cover 120 is opened. The first cover 141 forms the bent transport path 109*a* integrally with the second transport path member 108 in a state where the second roller unit 140 is attached to the second transport path member 108. On both sides of the first cover 141 along the X direction, an engagement portion 145 that engages with the second transport path member 108 is provided. A user may disengage the engagement portion 145 to cause the first cover 141 to be in a state of being opened. In the embodiment, the state where the first cover 141 is opened is also a state where the first cover 141 that holds the retard roller 143 is removed from the second transport path member 108. Specifically, the second roller unit 140 is removed from the second transport path member 108 in a state where the engagement portion 145 is disengaged. This allows the first cover 141 and the retard roller 143 included in the second roller unit 140 to be removed from the second transport path member 108.

The frame portion 142 is a frame-like member that is exposed upward in a state of being attached to the second transport path member 108, and rotatably supports both ends of a rotation shaft 143*a* along the X axis of the retard roller 143. The frame portion 142 includes a pivotal shaft 142*a* along the X axis, and both ends of the pivotal shaft 142*a* are pivotally held by the first cover 141. The frame portion 142 is also coupled to the first cover 141 via a biasing member 144 that biases the frame portion 142 downward along the Z axis. When viewed along the X axis from a side face, the rotation shaft 143*a* of the retard roller 143 is located frontward of the pivotal shaft 142*a* of the frame portion 142 in the Y direction, and the coupling position of the biasing member 144 is located backward of the pivotal shaft of the frame portion 142 in the Y direction. This allows the retard roller 143 to be pressed against the separate roller 133 located upward of the retard roller 143 in a state where the first cover 141 is closed.

Figure 9:
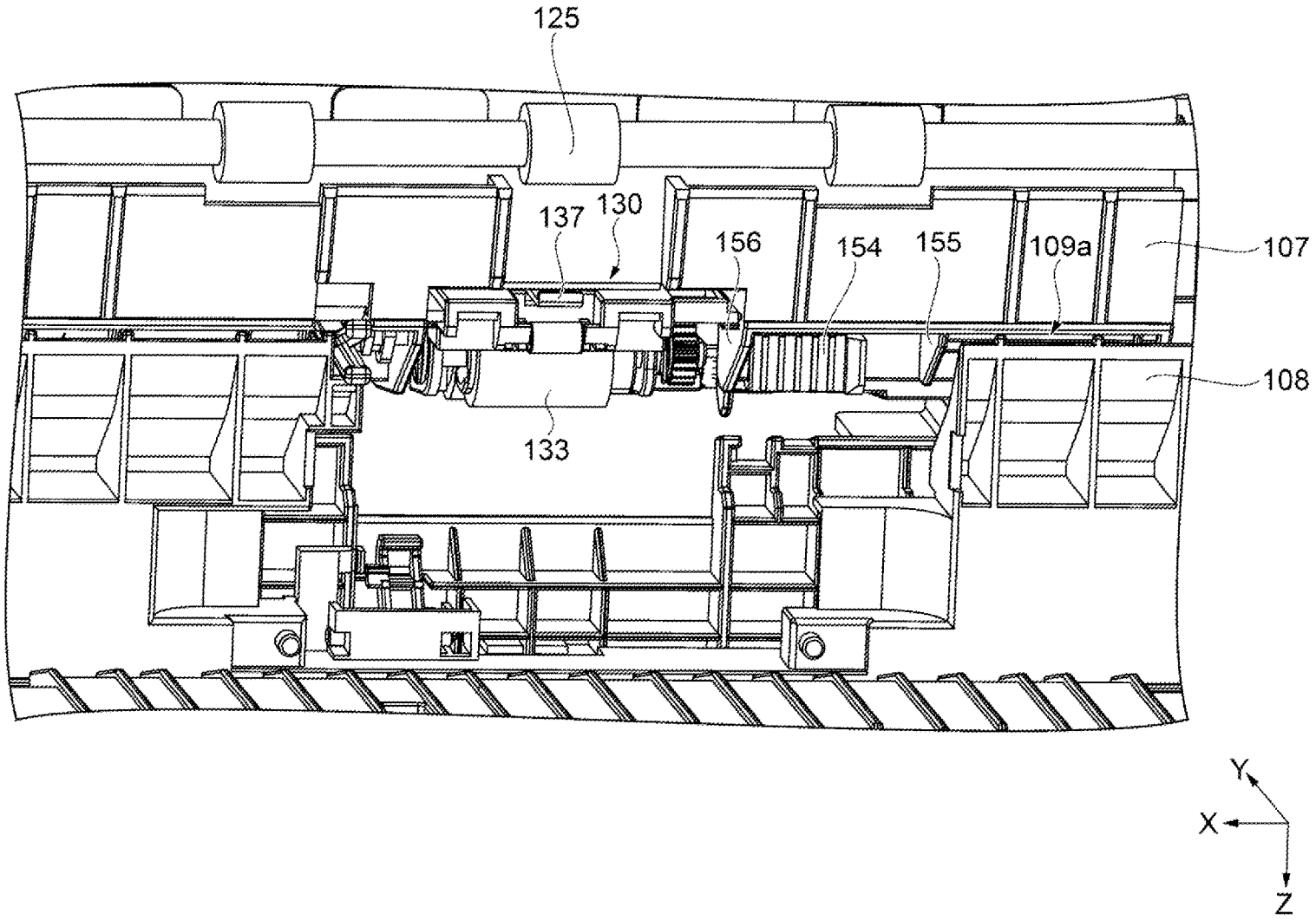
FIG. 9 is an enlarged view illustrating a state where a first cover is opened.

As illustrated in FIG. 9, a first roller unit 130 is removably attached to the first transport path member 107. The first roller unit 130 becomes removable by operating an operation unit 154 provided at the first transport path member 107. As illustrated in FIG. 6, the operation unit 154 is covered by the first cover 141 in a state where the second roller unit 140 is attached to the second transport path member 108.

Figure 10:
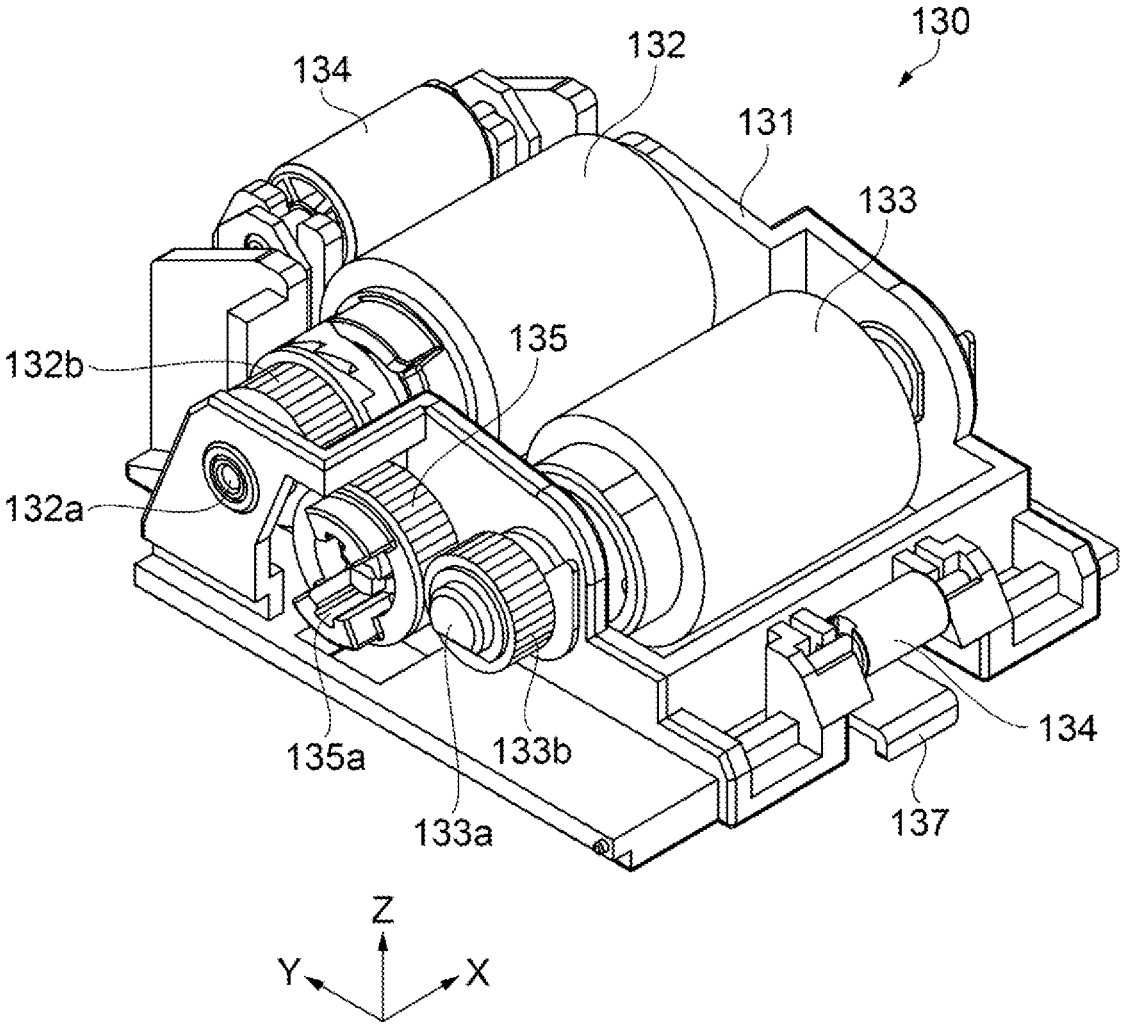
FIG. 10 is a perspective view illustrating a configuration of a first roller unit.

As illustrated in FIG. 10, the first roller unit 130 includes the pickup roller 132, the separate roller 133, and a first holding portion 131 that holds the pickup roller 132 and the separate roller 133.

The first holding portion 131 is a frame-like member that is exposed downward in a state of being attached to the first transport path member 107, and rotatably holds both ends of a rotation shaft 132*a* along the X axis of the pickup roller 132. The rotation shaft 132*a* includes a second gear 132*b* that transmits a drive force to the pickup roller 132.

The first holding portion 131 rotatably holds both ends of a rotation shaft 133*a* along the X axis of the separate roller 133. The rotation shaft 133*a* includes a third gear 133*b* that transmits a drive force to the separate roller 133. The separate roller 133 is disposed backward of the pickup roller 132 in the Y direction. The first roller unit 130 in the embodiment exemplifies a configuration including two auxiliary rollers 134 that are provided frontward of the pickup roller 132 and backward of the separate roller 133.

The first holding portion 131 includes a first gear 135 that meshes with the second gear 132*b* and the third gear 133*b*. At the rotation center of the first gear 135, a concave portion 135*a* is provided which receives a drive force that rotates the pickup roller 132 and the separate roller 133. The first gear 135 rotates to rotatably drive the pickup roller 132 via the second gear 132*b* and to rotatably drive the separate roller 133 via the third gear 133*b*. An engagement portion 137 that engages with the first transport path member 107 is provided at a rear end of the first holding portion 131 in the Y direction.

Figure 11:
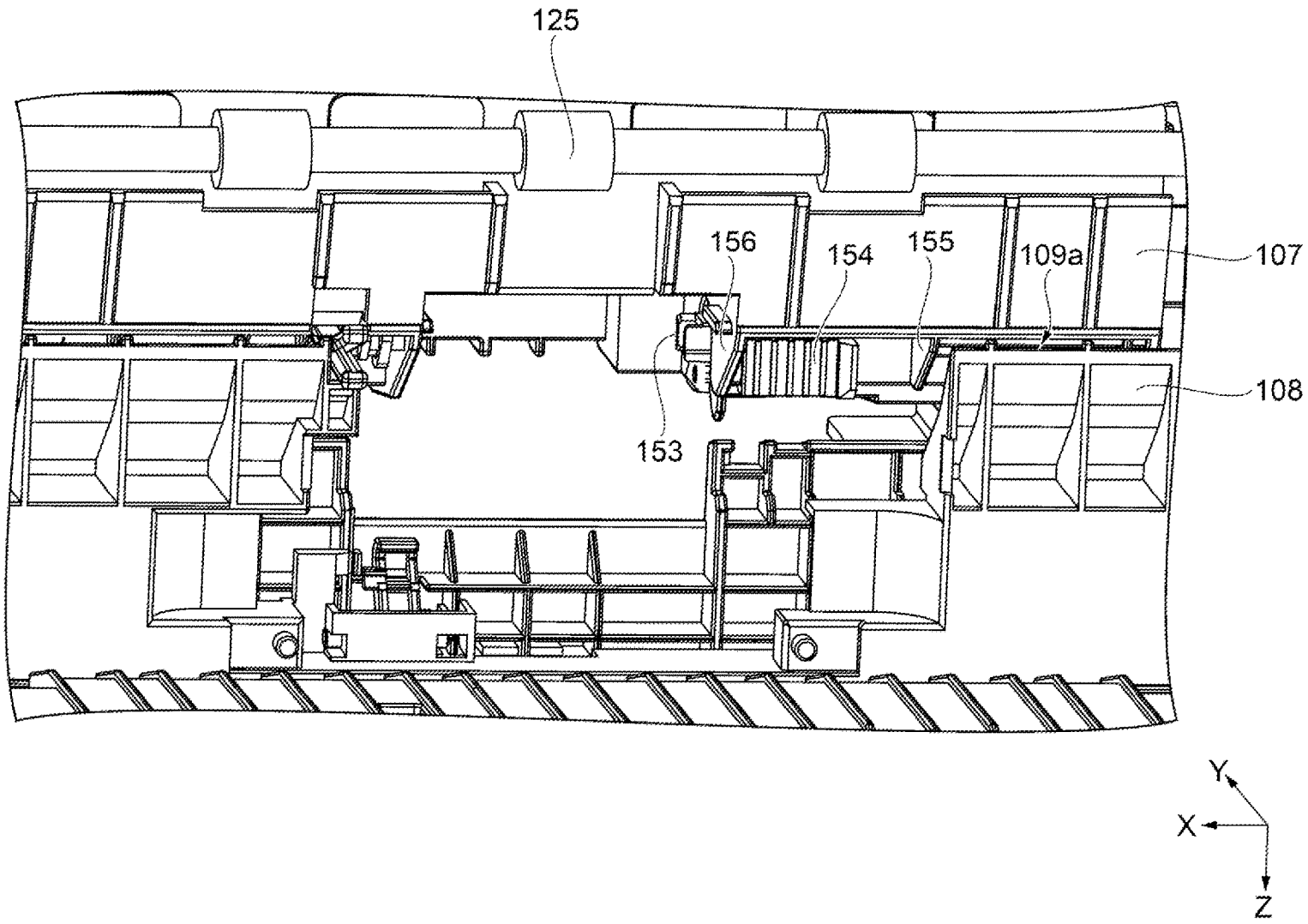
FIG. 11 is an enlarged view illustrating a state where a first roller unit is removed.
Figure 12:
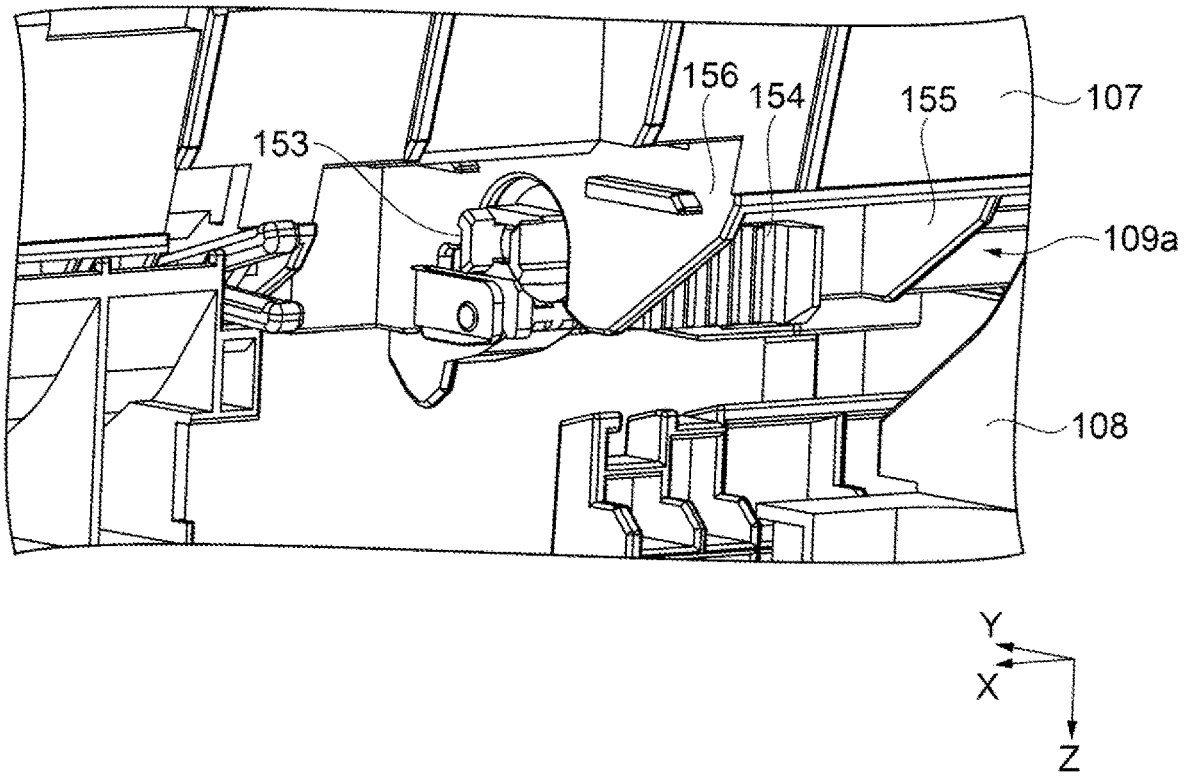
FIG. 12 is an enlarged perspective view of a clutch and an operation unit.

As illustrated in FIGS. 11 and 12, the operation unit 154 is located between a first rib 155 and a second rib 156 that are provided at the bent transport path 109*a* in the X direction, the X direction being a first axial direction parallel to the rotation shaft 132*a* of the pickup roller 132. The first rib 155 and the second rib 156 are members protruding from the first transport path member 107 to form the bent transport path 109*a*. That is, the operation unit 154 is located at a position at which the operation unit 154 can face the cut paper SP being transported by the pickup roller 132 and the separate roller 133. The operation unit 154 is for operating a movement of a clutch 153 that mates with the concave portion 135*a* of the first gear 135, and is configured to be slidable along the X direction. It is preferred that a distance between the first rib 155 and the second rib 156 in the X direction be 15 mm or greater.

Figure 13:
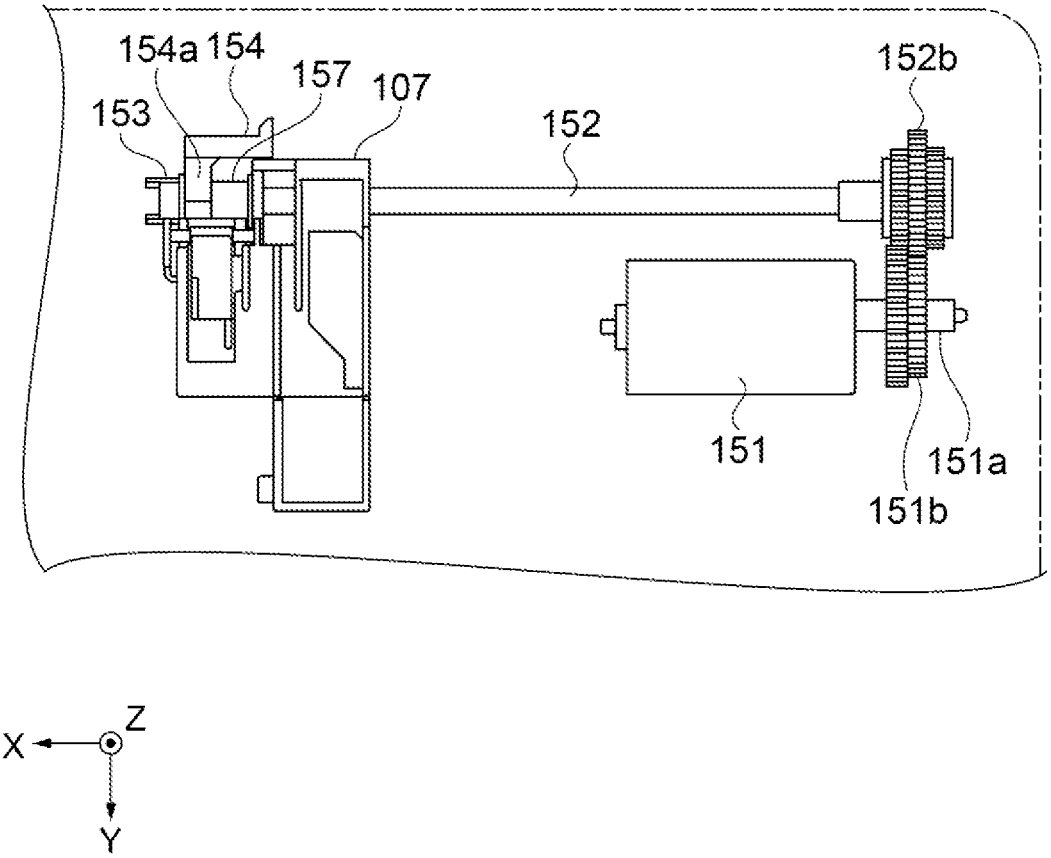
FIG. 13 is an explanatory view illustrating a transmission system of a drive force of a drive source.

As illustrated in FIG. 13, the feeding device 100 includes a drive source 151 that generates a drive force that rotates the pickup roller 132 and the separate roller 133, and the clutch 153 that transmits the drive force of the drive source 151 to the pickup roller 132 and the separate roller 133. Note that FIG. 13 illustrates a plan view viewed from below in the vertical direction.

The clutch 153 is a convex member that mates with the concave portion 135*a* of the first gear 135. The clutch 153 is coupled to one end of a shaft 152 extending in the X direction, and a fourth gear 152*b* is provided at the other end of the shaft 152. The drive source 151 is a motor, and an output shaft 151*a* from the drive source 151 extends parallel to the shaft 152. The output shaft 151*a* is provided with a fifth gear 151*b* that meshes with the fourth gear 152*b*. Such a configuration enables the shaft 152 to move in the X direction relative to the drive source 151.

The operation unit 154 includes a support portion 154*a* that extends frontward in the Y direction and supports the clutch 153. The shaft 152 is rotatably supported by the first transport path member 107, and is rotatably supported by the support portion 154*a* of the operation unit 154 and movably supported in the X direction. The support portion 154*a* is provided between the clutch 153 and the first transport path member 107 via a biasing member 157 in the X direction. The biasing member 157 biases the shaft 152 supported by the support portion 154*a* and the clutch 153 coupled to the shaft, toward a side of the first roller unit 130.

The clutch 153 is movable to a coupling position at which the drive force of the drive source 151 is transmitted to the concave portion 135*a* of the first roller unit 130, and a release position at which the drive force of the drive source 151 is not transmitted to the concave portion 135*a* of the first roller unit 130.

The coupling position indicates a state where the shaft 152 and the clutch 153 are biased by the biasing member 157 toward the side of the first roller unit 130 to cause the clutch 153 to mate with the concave portion 135*a*. This allows the drive force of the drive source 151 to be transmitted to the first roller unit 130.

The release position indicates a state where the operation unit 154 is operated by the user to slidably move in the X direction to an opposite side of the first roller unit 130 so that the shaft 152 and the clutch 153 are moved to the opposite side of the first roller unit to separate the clutch 153 from the concave portion 135*a*. This inhibits the drive force of the drive source 151 from being transmitted to the first roller unit 130. The clutch 153 is located at the release position when the operation unit 154 is operated by the user to slidably move, and located at the coupling position by the biasing force of the biasing member 157 when the user releases a hand away from the operation unit 154.

To summarize the above description, when the engagement portion 145 is operated by the user to be disengaged in a state where the second cover 120 is opened, the second roller unit 140 becomes removable from the second transport path member 108. That is, the retard roller 143 becomes replaceable.

When the operation unit 154 is operated by the user to slidably move and the engagement portion 137 is operated by the user to be disengaged in a state where the second cover 120 is opened and the first cover 141 is opened, the first roller unit 130 becomes removable from the first transport path member 107. That is, the pickup roller 132 and the separate roller 133 becomes replaceable.

Also, when the operation unit 154 is operated by the user to slidably move in a state where the second cover 120 is opened and the first cover 141 is opened, the first roller unit 130 becomes attachable to the first transport path member 107. Because the clutch 153 is constantly biased toward the side of the first roller unit 130, the drive source 151 can be rotatably driven to allow the clutch 153 to automatically mate with the concave portion 135*a* even if the clutch 153 incompletely mates with the concave portion 135*a* when the first roller unit 130 is attached to the first transport path member 107.

As described above, the feeding device 100 according to the embodiment enables to achieve the following advantageous effects.

The feeding device 100 includes the clutch 153 movable to the coupling position at which the drive force is transmitted to the pickup roller 132 that is the first roller and a release position at which the drive force is not transmitted to the pickup roller 132, and the operation unit 154 for operating the movement of the clutch 153. In addition, the operation unit 154 is provided at a position that can face the cut paper SP being transported. In other words, the operation unit 154 is provided at a position that is exposed when removing the cut paper SP that caused paper jamming, which makes the pickup roller 132 easily replaceable.

Because the operation unit 154 is covered by the first cover 141, the operation unit 154 can be suppressed from being erroneously operated when the second cover 120 is opened for the purposes other than removing the pickup roller 132.

The pickup roller 132, and the separate roller 133 that is the third roller are both held by the first holding portion 131. The retard roller 143 as the second roller that presses against the separate roller 133 is removed when the first cover 141 is opened. In other words, the pickup roller 132 is easily removable together with the separate roller 133 because the separate roller 133 is not pressed when the pickup roller 132 is removed.

The operation unit 154 is located between the first rib 155 and the second rib 156 provided at the bent transport path 109*a*. That is, the operation unit 154 is provided at a space formed between the first rib 155 and the second rib 156, thus suppressing an increase in a transport load and an erroneous operation of the operation unit 154 that are caused when the cut paper SP being transported along the bent transport path 109*a* is in contact with the operation unit 154.

The distance between the first rib 155 and the second rib 156 is 15 mm or greater. According to the statistic by Artificial Intelligence Research Center of National Research and Development Institute of Advanced Industrial Science and Technology, 98% of persons who participated the measurement have Index finger depth, distal D04 of 14.8 mm or less (Makiko Kouchi: AINST Japanese Hand Dimension Data. https://unit.aist.go.jp/hiri/dhrg/ja/hand/index.html). That is, because most of the persons have a width of the first joint of the index finger of 14.8 mm or less, the distance between the first rib 155 and the second rib 156 between which the operation unit 154 is provided is made 15 mm or greater, which makes the operation unit 154 easily operable.

Note that, in the feeding device 100, the description is given in which the first roller is the pickup roller 132 and the third roller is the separate roller 133, and the first roller may be the separate roller 133 and the third roller may be the pickup roller 132.

The feeding device 100 includes the separate roller 133 as the first roller, the retard roller 143 as the second roller, the pickup roller 132 as the third roller, and the like that transport the cut paper SP. The retard roller 143 is held by the first cover 141, and is pressed against the separate roller 133. The state where the first cover 141 is opened is also a state where the first cover 141 holding the retard roller 143 is removed from the second transport path member 108.

According to the above configuration, the following advantageous effects can be achieved.

The feeding device 100 includes the clutch 153 movable to the coupling position at which the drive force is transmitted to the separate roller 133 that is the first roller and the release position at which the drive force is not transmitted to the separate roller 133, and the operation unit 154 for operating the movement of the clutch 153. In addition, the operation unit 154 is provided at the position that can face the cut paper SP being transported. In other words, the operation unit 154 is provided at the position that is exposed when removing the cut paper SP that caused paper jamming, which makes the separate roller 133 easily replaceable.

The separate roller 133, and the pickup roller 132 that is the third roller are both held by the first holding portion 131. The retard roller 143 as the second roller that presses against the separate roller 133 is held by the first cover 141, and is removed when the first cover 141 is opened. The separate roller 133 is easily removable together with the pickup roller 132 because the separate roller 133 is not pressed when the pickup roller 132 is removed.

Further, the feeding device 100 described in the embodiment exemplifies the configuration in which the pickup roller 132 and the separate roller 133 are unitized at the first roller unit 130, and a configuration in which the pickup roller 132 is separated from the separate roller 133 may be employed as well. According to this configuration, it is possible to only replace the separate roller 133 as the first roller or the pickup roller 132 as the first roller.

What is claimed is:

1. A feeding device, comprising:

a loading unit at which a printing medium is loaded;

a first roller that transports the printing medium;

a transport path member at which the first roller is disposed, the transport path member constituting a transport path on which the printing medium is transported;

a drive source that generates a drive force that rotates the first roller;

a clutch that is movable between a coupling position at which the drive force of the drive source is transmitted to the first roller, and a release position at which the drive force of the drive source is not transmitted to the first roller;

a clutch operator mechanically coupled to the clutch and operating a movement of the clutch by being moved so that the clutch moves to the release position without moving the first roller;

a first cover that, when in a closed state, covers the first roller and the clutch operator so as to block user operation of the clutch operator, includes an engagement portion that engages with the transport path member, and opens by being disengaged with the transport path member;

a first holding portion that holds both ends of a rotational shaft of the first roller;

a third roller held by the first holding portion; and a second roller held by the first cover and pressed against the third roller, wherein the clutch operator is provided at a position, on the transport path member, facing the printing medium being transported by the first roller, the first roller is removable from the transport path member when the clutch is located at the release position, and the second roller is configured to be removable from the transport path member in a state where the first cover is in an opened state.

2. The feeding device according to claim 1, comprising:

a second cover that covers the first cover, wherein in a state where the second cover is opened, the transport path and the first cover are exposed, and in a state where the second cover is opened and the first cover is opened, the clutch operator becomes operable to move the clutch and the first roller is removable from the transport path member.

3. The feeding device according to claim 2, comprising a second roller held by the first cover and pressed against the first roller, wherein the second roller is configured to be removable from the transport path member in a state where the first cover is opened.

4. The feeding device according to claim 1, wherein a first rib and a second rib are provided on the transport path, and the clutch operator is located between the first rib and the second rib in a first axial direction parallel to a rotation shaft of the first roller.

5. The feeding device according to claim 4, wherein a distance between the first rib and the second rib in the first axial direction is 15 mm or greater.

* * * * *